US008191938B2

(12) United States Patent
Zimmerlee

(10) Patent No.: US 8,191,938 B2
(45) Date of Patent: Jun. 5, 2012

(54) PUSH-PULL TYPE DOOR LATCH WITH MOTION TRANSFER BELT

(76) Inventor: James David Zimmerlee, Oxford, WI (US)

( * ) Notice: Subject to any disclaimer, the term of this patent is extended or adjusted under 35 U.S.C. 154(b) by 481 days.

(21) Appl. No.: 12/380,748

(22) Filed: Mar. 4, 2009

(65) Prior Publication Data

US 2010/0225124 A1 Sep. 9, 2010

(51) Int. Cl.

| | |
|---|---|
| ***E05B 65/10*** | (2006.01) |
| ***E05B 3/00*** | (2006.01) |
| ***E05C 3/02*** | (2006.01) |
| ***E05C 19/10*** | (2006.01) |
| ***E05C 3/16*** | (2006.01) |

(52) U.S. Cl. ..... 292/92; 292/194; 292/126; 292/226; 292/336.3

(58) Field of Classification Search ..... 292/92–94, 292/336.3, 194, 200, 95, 126, 121, 100, 219, 292/DIG. 29

See application file for complete search history.

(56) References Cited

U.S. PATENT DOCUMENTS

| | | | | |
|---|---|---|---|---|
| 2,699,351 | A * | 1/1955 | Platt | 292/254 |
| 3,869,159 | A * | 3/1975 | Eads | 292/92 |
| 4,003,593 | A * | 1/1977 | Wilzig et al. | 292/92 |
| 4,081,980 | A * | 4/1978 | Hightower | 70/92 |
| 4,324,425 | A * | 4/1982 | Logan | 292/201 |
| 4,526,057 | A * | 7/1985 | Mochida et al. | 74/502.2 |
| 6,196,599 | B1 * | 3/2001 | D'Hooge | 292/165 |
| 6,293,598 | B1 * | 9/2001 | Rusiana | 292/143 |
| 6,311,367 | B1 * | 11/2001 | Larsen | 16/375 |
| 7,048,464 | B2 * | 5/2006 | Ronnquist | 403/321 |
| 2007/0138802 | A1 * | 6/2007 | Stasko et al. | 292/201 |
| 2008/0264121 | A1 * | 10/2008 | Marko | 70/208 |

* cited by examiner

*Primary Examiner* — Thomas Beach
*Assistant Examiner* — Nathan Cumar
(74) *Attorney, Agent, or Firm* — Casimir Jones SC

(57) ABSTRACT

A push-pull type door latch opens a door by applying direct mechanical force on the pull side, and by remote action on the push side through conveying a force through a motion transfer belt that connects the two handles. The latch involves no access holes in the door so each handle may be situated at offset positions with respect to each other.

4 Claims, 6 Drawing Sheets

PUSH-PULL TYPE DOOR LATCH WITH MOTION TRANSFER BELT

FIELD OF THE INVENTION

This invention relates to the field of consumer and industrial fixtures designed for operating doors. A push-pull type door latch allows an individual to unlatch a door from either side. A push type door assembly permits conveying a signal activating or de-activating a functional apparatus on the opposite side of a door. The invention makes it possible to adjust the height and vary the position of the door fixtures without penetrating the body of the door itself, which has wide-spread applications in both consumer use and industrial contexts such as nursing homes, hospitals, and manufacturing plants.

BACKGROUND OF THE INVENTION

Most bi-functional door latches have handles on either side of the door, a latching mechanism consisting of a bolt contained in a cavity that can alternately be extended into or retracted from an aligned orifice in the door jamb, and an opening in the door beneath the handle position communicating with the bolt cavity. Conventional door latches operate by simultaneous turning of a door knob in either direction to retract the bolt, and pushing or pulling to open the door. In push-pull type latches a push on the handle from the inside of the door and a pull on the handle from the outside of the door releases the bolt and opens the door in one continuous motion. Typically, the door opening between the handles contains a mechanism which translates the turning motion of the knob or the push-pull force on the handle into horizontal action to retract the bolt.

U.S. Pat. Nos. 6,293,598 and 7,258,374 disclose a push-pull type latch in which motion of the handle is translated to the bolt by a cam configured to engage a planar surface of the handle. Deflection of the handle is restricted by a stop, which is said to reduce wear on the moving components of the latch. The handle is under spring-loaded pressure so that when a pushed handle is released, the handle returns to its original position. Similarly, U.S. Pat. No. 4,629,228 discloses a complicated internal latch mechanism for displacing a bolt, utilizing a rotating cam responsive to deflection of the handle, and translated to the bolt by engagement of a driver tab on a slide member. U.S. Pat. Nos. 6,196,599, 5,085,474, and 4,003,593 describe further embodiments of push-pull type latches that utilize rotational components, such as a crank or cam internal to the door to translate push-pull vertical motion into horizontal movement of the bolt.

The afore-mentioned background art represent devices with several features in common, distinguishable from the present invention. These inventions all utilize mechanically sophisticated mechanisms internal to the door having moving parts to translate push-pull force on the handle to horizontal displacement of the bolt. This necessitates providing two holes in the door itself, one through the door to accommodate access of the handles to the motion translation mechanisms, and other hole to retain the bolt situated at a right angle to the first and communicating therewith. A second common feature is a requirement that the latch on either side of the door must be in the same corresponding geometric plane position on the door. Finally, these holes must be made very precisely in order to assure proper alignment of the latch components, so that installation thereof is not trivial or routinely performable by the end user.

SUMMARY OF THE INVENTION

Push-pull type door latches have an advantage over other convention door opening mechanisms in that opening is effected by a single continuous motion. This feature has particular efficacy in situations, as in food handling facilities or hospitals, where a person is carrying an object occupying both hands. Such person entering a space with an inward opening door need only press on the latch handle with a wrist, elbow, or shoulder to gain entry. A disadvantage to conventional push-pull latches is that the position of the handles is predetermined by the place in the door where the access holes are bored. Repositioning the latch members necessitates reboring the holes, and constrains the position of the latch on either side of the door to the same position.

It is therefore an objective of the present invention to provide flexibility in the positioning of the latch handles, and to allow latches on either side of a door to be asymmetrically situated with respect to both horizontal and vertical dimensions.

It is a further objective to mount a door latch without penetrating the body of the door itself, thus permitting readjustment of the position of the latch handles at will. This feature also provides for ease of installation without professional intervention. In a still further objective, the novel latch permits control of a functional apparatus mounted on one side of a door from the opposite side.

According to the present invention, a universal push-pull type door latch is adapted for securing a door in secured closed position within a door casing. The door has a front opening side and a back side surface which abbuts a doorjamb on its closing edge. The edged surface conventionally closes within the door casing. The latch has a substantially horizontal mounting bracket with a base portion mounted on each side of the door, and an upper and lower flange portion extending horizontally and perpendicularly to the base portion. The flanges have bores aligned to receive one or a plurality of pivot pins. The door latch has a master pull handle and a slave push handle. The master pull handle, having an inner and an outer surface, comprises a substantially triangular portion and a gripping portion extending in a direction towards the door cases. A bushing to accommodate a pivot pin is positioned in the triangular corner of the handle at the corner proximate to the door edge surface. The handle is sized to fit within the flanges of the mounting bracket, and is secured in place by the pivot pin passing through the bushing and the aligned bracket bores. This provides an axis of rotation for the handle, which moves through an arc as the master handle is pulled forward. Protruding from the outer surface of the master handle triangular portion is a pawl engageable with grooves in a strike plate mounted on the casing or doorjamb in secured closed position. A torsion spring is disposed in the handle to urge pressure to the pawl in the strike plate groove.

On the opposite, back side of the door a mounting bracket is placed at any desired location. A slave push handle which may be identical in design to the master handle is mounted through its bushing and aligned bracket bores, only in opposite configuration from the master handle with the gripping portion extending in a direction away from the door casing. The slave handle thus rotates about an axis of rotation on the inner side of the substantially triangular portion of the handle.

A two ended flexible motion transfer belt is disposed between the master and salve handles circumscribing the edged door surface and anchored at one end on the outer surface of the master pull handle triangular portion and at the other end anchored on the inner surface of the slave handle to provide mechanical advantage to remotely disengage the paul from the strike plate groove when the slave push handle is inwardly deflected. On the master handle side of the door, the pawl is disengaged from the strike plate groove when the handle to which is attached is outwardly deflected.

The push-lull latch of the present invention is readily adapted to incorporate a locking assembly which disables the push handle by creating slack in the motion transfer belt. In locking mode, the distance of travel of the slave handle is too short to translate its motion to the master handle. The locking assembly has a rotatable idler arm bearing a substantially vertical slot. It is secured to the mounting bracket by a pivot pin passing through a bushing mounted thereon on the opposite end of the mounting bracket from which the master handle is mounted The idler arm bushing is aligned with bores in the upper and lower bracket flanges on the opening side of a door to provide an axis of rotation. The upper or lower bracket flange has a beveled locking tab projecting vertically, so that the motion transfer belt passing through the idler arm slot, disposed between the master and slave handles is tautened sufficiently for motion transfer to occur when the idler arm is in locking engagement with the flange locking tab. Sufficient space is designed between the tab and the base portion of the mounting bracket to allow interposition of the idler arm. There is enough space between the pin and bushing of the idler arm to permit traverse of the idler arm lower edge over the beveled tab.

The principles of the present invention may be generally applied to situations in which its is desirable to convey mechanical advantage from the back side surface of a door abutting a doorjamb on its closing edge to the opening side front surface. Such a push-type door assembly has a spring loaded push pedal having an inner and outer surface and comprising a functionally triangular portion mounted in a bracket by mounting means. This portion of the pedal has a bushing at its inner leg to accommodate a pivot pin at the distal triangular corner of the triangular portion from the door edge to provide an axis of rotation for the pedal. A functional apparatus, such as a bell, light, or other appliance capable of activation or inactivation by lateral force is mounted on the opening side surface of the door. Communication between pedal and the functional apparatus is effected by a two ended flexible motion transfer belt disposed between the inner surface of the pedal, circumscribing the door edge, and attached to a switch or motion arm, capable of responding to deflection of the pedal transmitted through the motion transfer belt.

DETAILED DESCRIPTION OF THE PREFERRED EMBODIMENT

Figure 1:
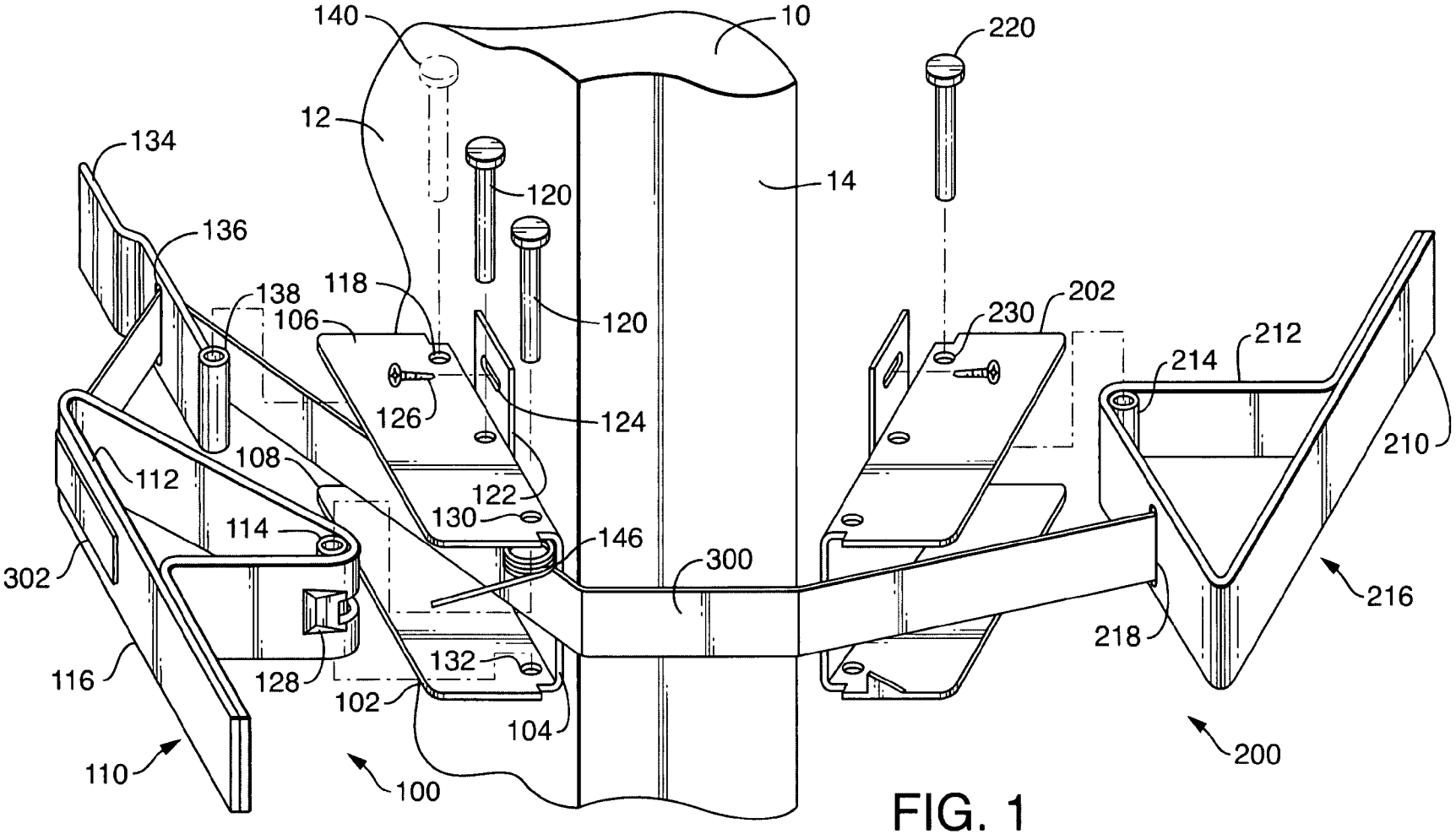
FIG. 1 is a perspective partially exploded drawing of a push-pull door latch as viewed from the edge of a door.

The push-pull door latch of the present invention allows easy installation on a new or existing door, and eliminates the internal mechanism in conventional latches that converts the push or pull motion of the handles into horizontal movement for engagement and disengagement of a bolt in a door casing oriface. FIG. 1 shows a door 10 having a front opening side 12 and an edge 14. The components for the pull side are shown on the left 100 and those for the push side are shown on the right 200. The pull latch includes a mounting bracket 102 consisting of a base portion 104, an upper flange portion 106, and lower flange portion 108. Both flange portions have bores 118 aligned in upper and lower registration to receive one or a plurality of pivot pins 120. The mounting bracket 102 is may be mounted horizontally, but does not require precise leveling. This embodiment is shown with a mounting bracket tab 122 with a slot 124 through which a mounting screw 126 can be inserted and tightened to secure the bracket 102. However, mounting the bracket 102 by mechanical means is optional. Preferably an adhesive or double sided adhesive tape is used instead to secure the bracket 102 without making screw holes.

Figure 3:
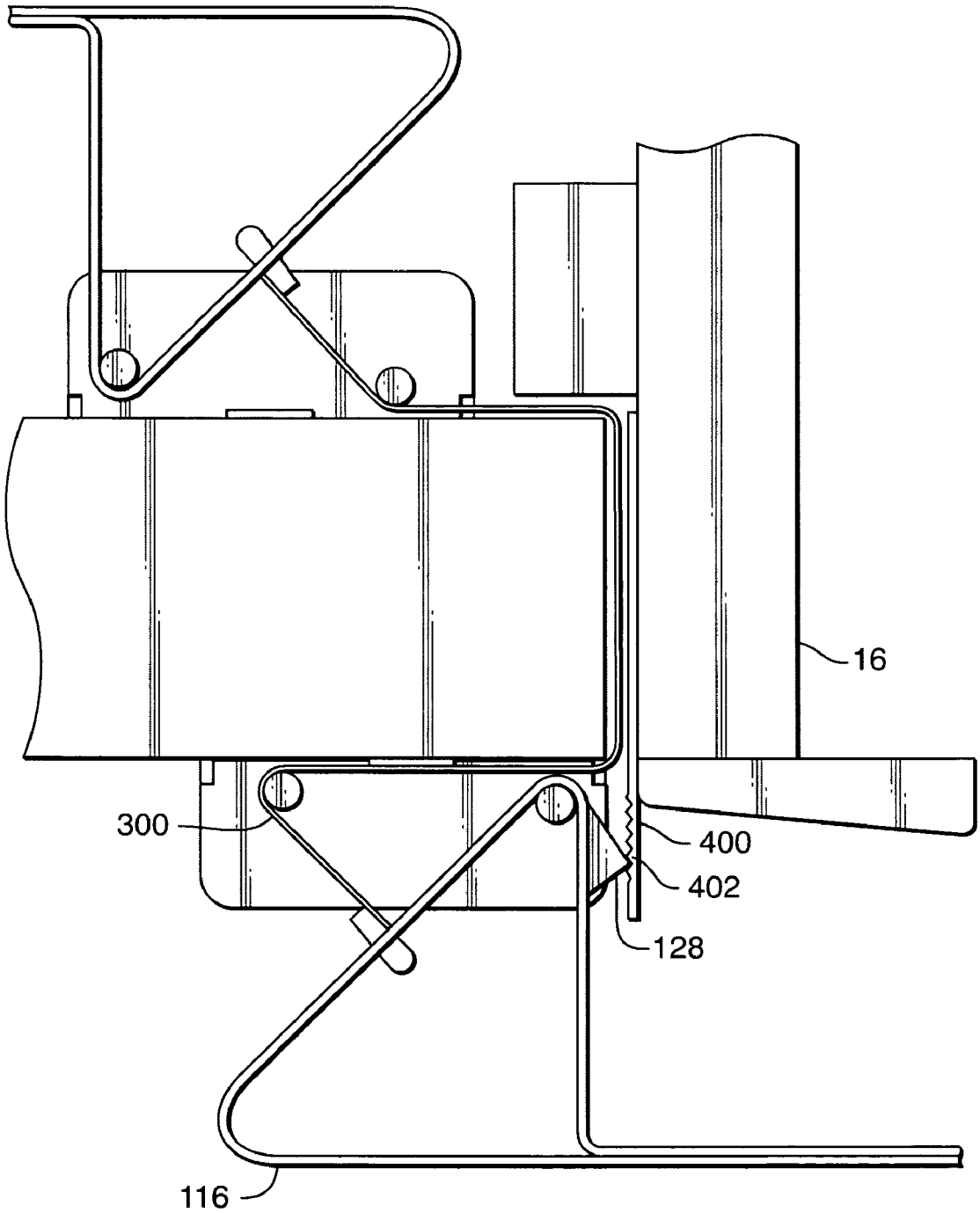
FIG. 3 is a perspective view of the pull handle showing engagement of the pawl in the strike plate.

The master pull handle 116, having an inner and an outer surface, comprises a generally triangular portion 112 having and a gripping portion 110. In the corner closest to the door casing (not shown) is a bushing 114 aligned to receive a pivot pin 120. When assembled, the pull handle 116 fits between the upper flange portion 106 and the lower flange portion 108 of the mounting bracket 102, and the pivot pin 102 is inserted through the pivot bore 130, the bushing 114, and the lower pivot bore 132. Preferably the pivot pins have heads larger than the pivot bores so they are held in place by gravity. The master pull handle 116 has a pawl 128 protruding from it which engages a vertical groove in a strike plate embedded in the door casing. Parenthetically referring to FIG. 3, this top view shows the pawl 128 engaged in a groove 402 of the strike plate 400 embedded in a doorjamb 16. Preferably, the strike plate 16 is embedded so that its outer surface is flush with the door jamb 16. To maintain the pawl 128 in its groove, a torsion spring 146 urges a constant pressure against the master handle 116 outer surface using its free prong as leverage against the mounting bracket base portion 104. The torsion spring 146 is positioned in alignment with the flange bores 130 and 132, and circles the pivot pin 120.

Referring to the right side of FIG. 1 200, the components of the slave handle side are illustrated. The push slave handle 216 is identical to the master pull handle 116 but is assembled in a 180 degree rotational position, and has a slot 218 in the triangular leg of the slave handle 216 facing the door. The mounting bracket 202 is identical to the mounting bracket 102. When assembled the bushing 214 will be aligned with the flange bore 230 of the mounting bracket 202 and be secured at the fulcrum of the triangular handle portion 216 by a pivot pin 220.

FIG. 1 also partly illustrates the configuration of some components of an optional locking assembly with respect to the overall latch assembly. The locking feature utilizes a rotatable idler arm body 134 having a bushing 138, and a slot 136. The idler arm body 134 is assembled as for the handles by aligning the arm body 134 with the upper 118 and lower flange bores (not visible in this view) and inserting a pivot pin 140.

A key feature of the present invention is the means for releasing the pawl 128 from the strike plate groove, as more fully described hereafter. On the master pull side 100 the pawl release occurs directly when the master handle 116 is pulled because the pawl 128 is attached to it. On the push side 200 release of the pawl 128 is obtained through a flexible motion transfer belt 300 which extends from the inside surface of the slave handle triangular portion 112 through a slot 218, then around the edge of the door and terminates on the outer side of the master handle 116. When the slave handle is pushed, motion is transferred via the motion transfer belt 300 to create a pulling action on the master handle 116, thereby releasing the pawl 128 remotely. If the latch assembly is equipped with a locking assembly, partly described above, the motion transfer belt 300 also passes through a slot 136 in the idler arm 134. Referring to the "triangular" aspect of the master and slave handles, this means only that the motion transfer belt 300 is placed at its ends at points on the handles where a mechanical advantage is obtained. Since mechanical advantage is exerted to cause movement through an arc about an axis of rotation at the pivot pin, thus defining a functional triangulation, the handles are characterized as "triangular". Even though the actual shape of the handles is depicted as triangular, there is no absolute requirement for this, so long as functional triangularity is embodied in the device.

It will be apparent to those skilled in the art that the motion transfer belt permits provides substantial flexibility by eliminating fixed position holes in the door. Thus, there is versatility in placing either side of the latch in virtually any horizontal or vertical position on the door. Each latch half can be at a different height and distance from the door edge The motion belt 300 may be any thin flexible tape, belt, wire, cable, or fabric capable of overcoming the friction generated at the door edge during motion transfer. Experiments have shown that this means of remotely operating the master handle 116 from the push side 200 has universal efficacy with conventional doors. The door itself and the door casing are parallel when the door is closed. As the door opens, the angle between the door edge and the casing changes and requires more space between the door edge and the door to clear the casing. If the fit of the door to its casing is tight enough to cause binding of the motion transfer belt, it is too tight for the door to open at all.

Figure 2A:
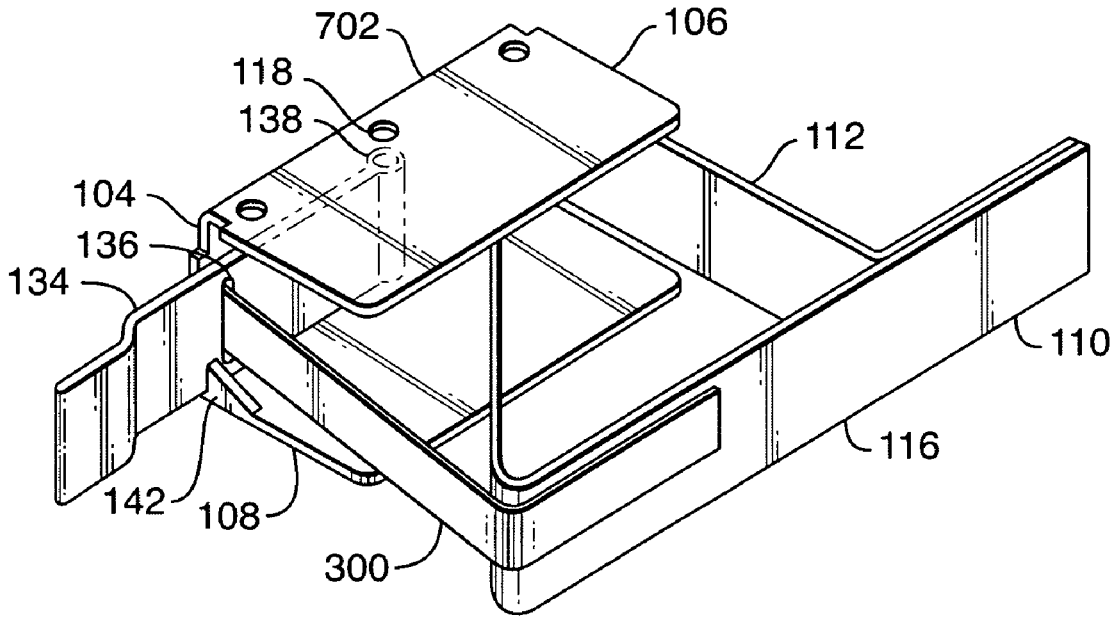
FIGS. 2A and 2B.are perspective views of the locking assembly in locked position (2A) and closed position (2B).
Figure 2B:
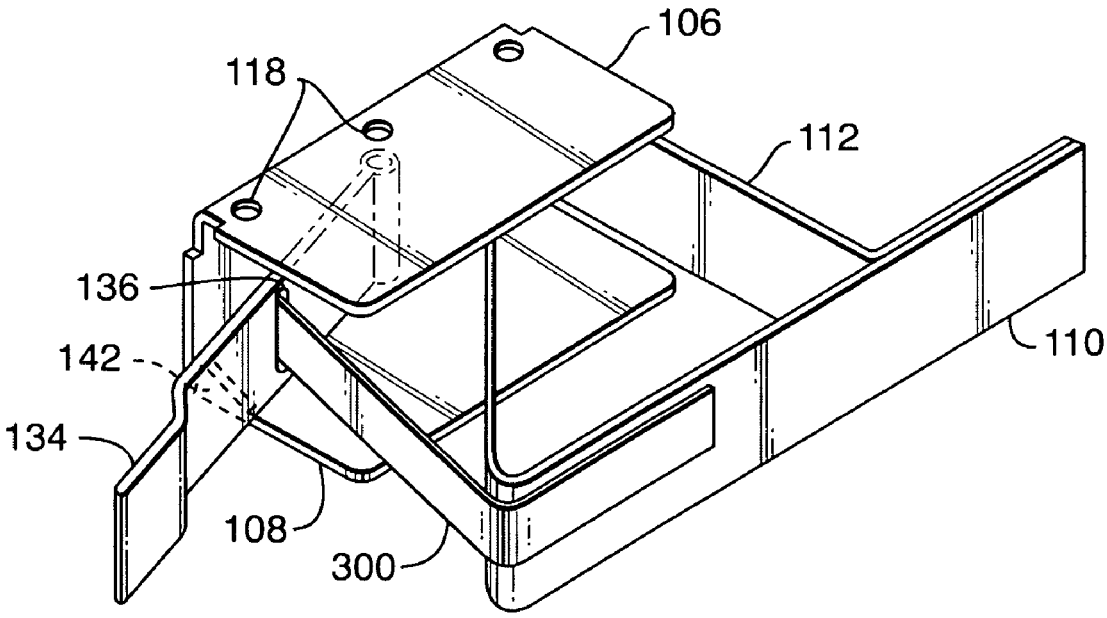

Referring again to the locking assembly of the present invention, FIGS. 2A and 2B illustrate the operation of the locking function in its closed and open positions respectively. In closed position, the latch assembly is unlocked; in the open position, the latch assembly is locked, in the sense that the slave push handle is disabled. FIG. 2A shows the closed (unlocked) configuration of parts. The rotatable idler arm 134 fits between the upper 106 and lower 108 flanges of the mounting bracket 102 of the master handle assembly 100, and secured by a pivot pin (not shown) passing through a pivot bore 118, the bushing 118 (shown in dotted line relief), and a pivot port on the lower flange 108.(not shown). To achieve the closed position, the idler arm 134 is rotated past a beveled locking tab 142 projecting vertically from the lower flange 108. The space between the beveled locking tab 142 and the base portion 104 of the mounting bracket 102 is sufficient to accommodate the thickness of the idler arm 134. The directionality of the bevel is upwards from the outer portion of the lower or upper flanges 106 and 108. Although shown in FIG. 2A as placed on the lower flange 108, the locking tab 142 may be on either the upper or lower such flange.

FIG. 2B illustrates the locking assembly in the open position. The idler arm 134 is rotated so that it is positioned in front of and distal to the locking tab 142 (shown in dotted line relief). This loosens the motion transfer belt 300 creating a slack, so that when the slave handle is pushed, release of the pawl is disabled, thereby locking out access from the slave handle side 200 of the latch assembly.

Figure 4:
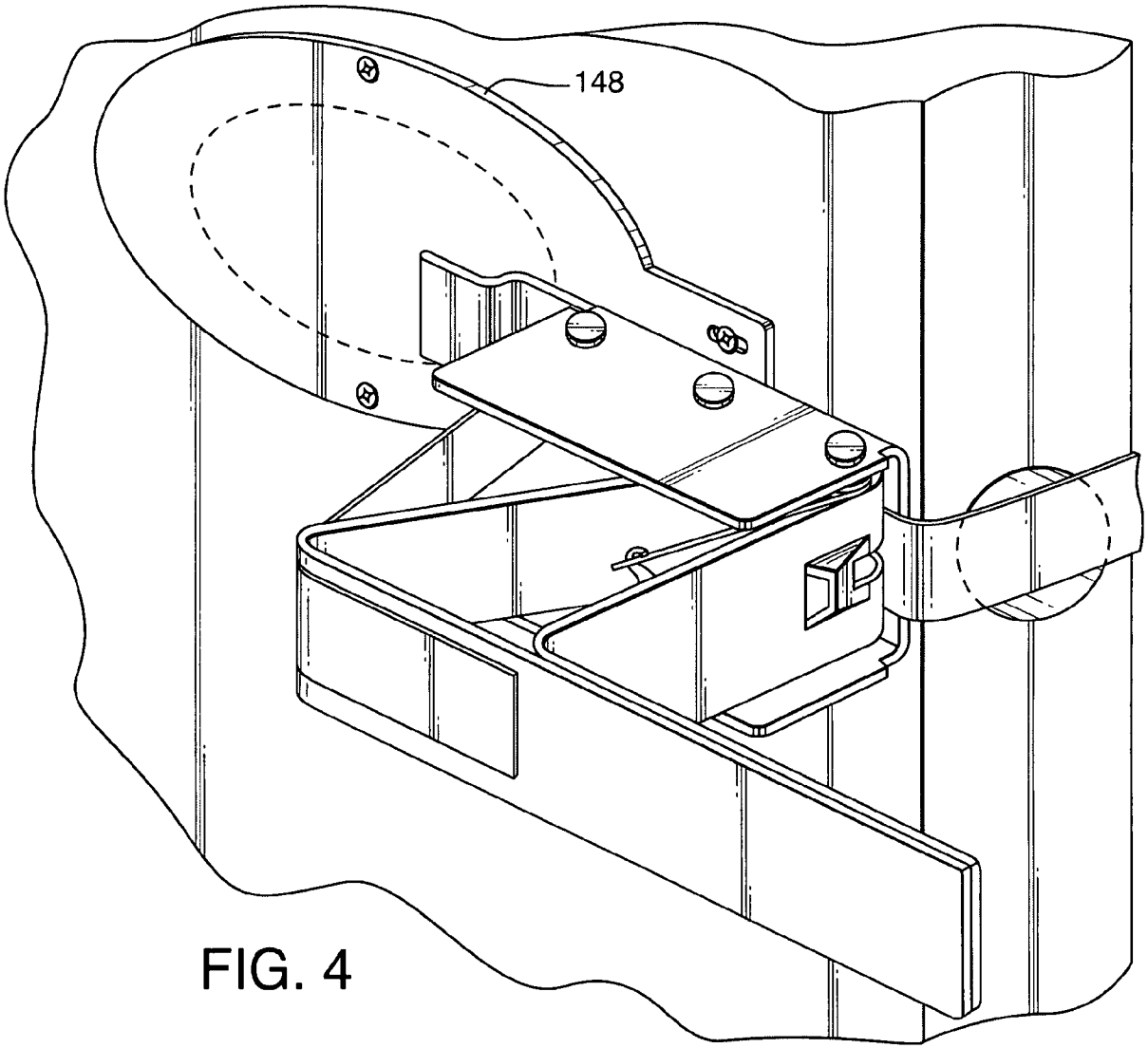
FIG. 4 is a perspective view of the pull side of the latch having a cover plate for disguising a previously drilled door hole.
Figure 5:
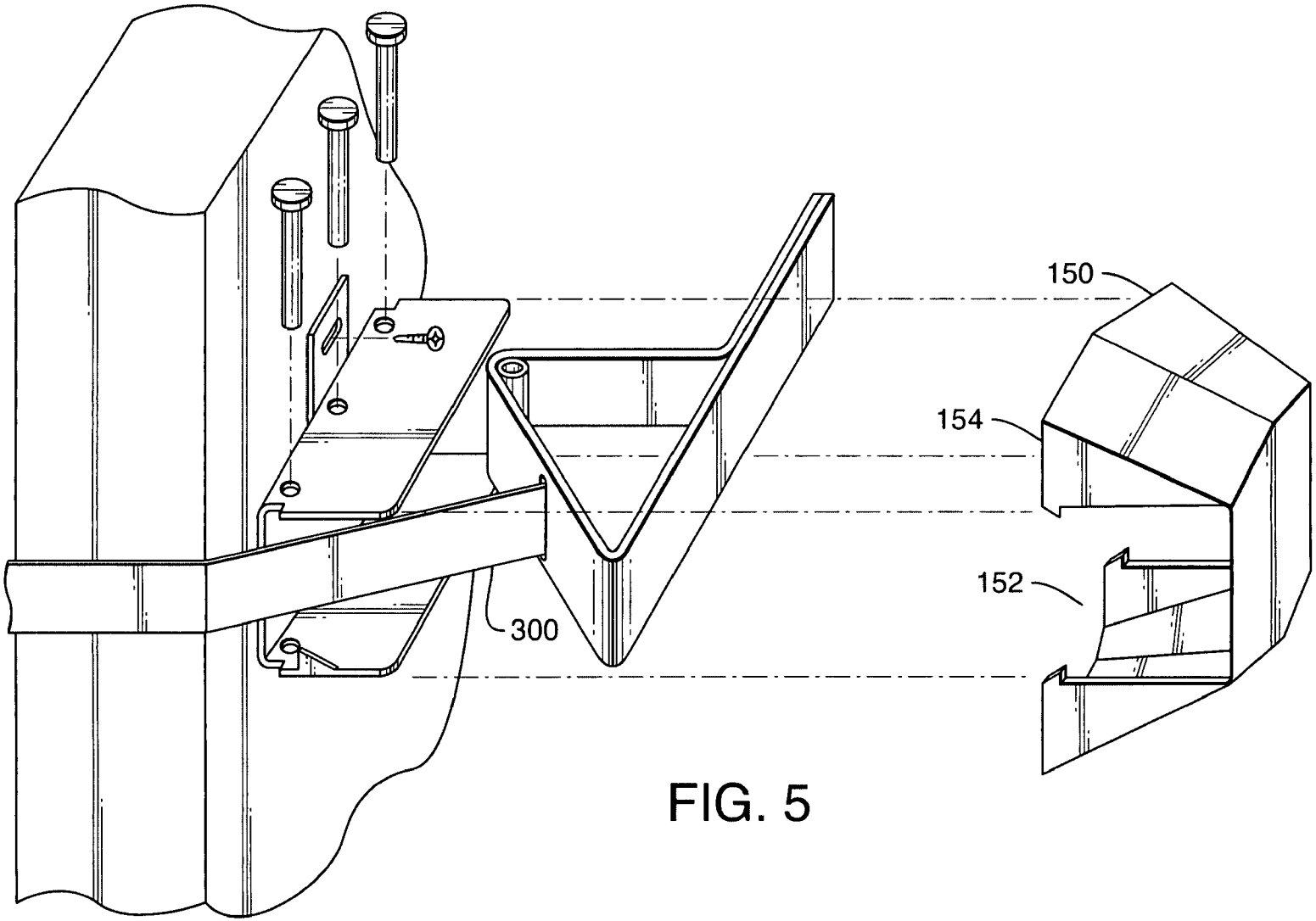
FIG. 5 is a perspective view of the push side of the latch featuring a housing.
Figure 6:
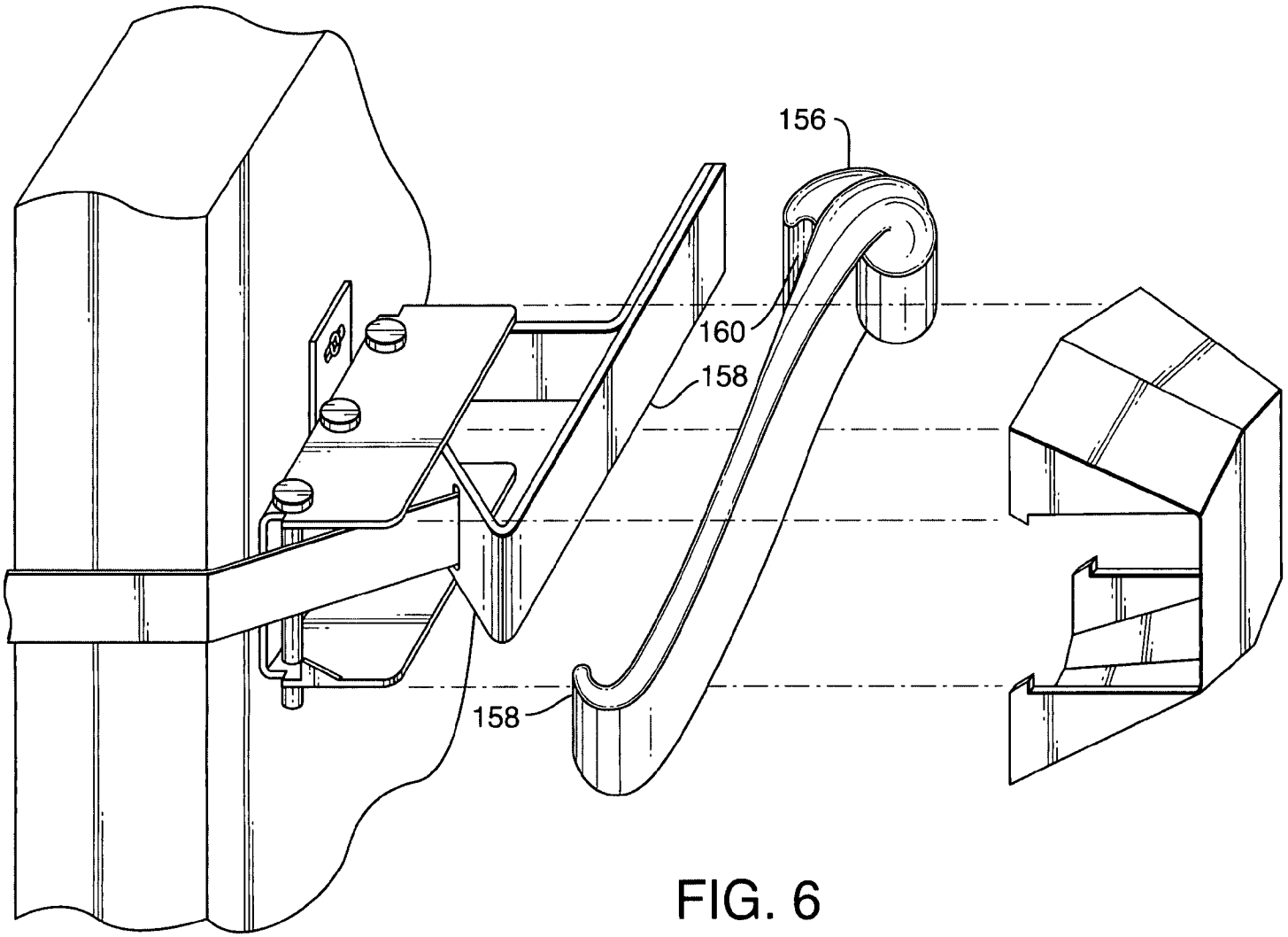
FIG. 6 shows one side of the latch assembly with an interchangeable ornamental accessory for the handle.

FIG. 4 shows the latch of the present invention with an oval underplate 148. This component may take any decorative shape and size, and is intended to disguise a pre-existing hole in a door being converted to the present latch assembly. It's sole function is to create a more aesthetic presentation of the latch in a door previously fitted with a conventional latch or door knob. FIG. 5 illustrates a housing 150 which is an enclosure that fits over and substantially covers the latch mechanism, leaving holes 152 in the side-panels 154 to permit access to the handles and the motion transfer belt 300. FIG. 6 illustrates an example of a decorative handle cover 156. The example shown is somewhat ornate, but many styles may be adopted to appeal to individual user's tastes. The curvature and length of the handle cover 156 is made to conform to the contours of the handle body on the side facing the user. To ensure that it remains in place without bolts, screws, or other fasteners, the handle cover 156 preferably has a lip 160 at the end of the handle, and a second lip 158 engaging the first curved portion of the handle.

What is claimed is:

1. A universal push-pull door latch for securing a door in secured closed position within a door casing, the door having a front opening side surface, a back side surface abutting on its closing edge a door jam, and an edged surface closing within the door casing, said latch comprising a substantially horizontal mounting bracket having a base portion mounted by mounting means on each side of the door, said mounting bracket having an upper and lower flange portion extending horizontally and perpendicular to said base portion, with bores in said flange portions aligned to receive one or a plurality of pivot pins a master pull handle having an inner surface and an outer surface, said handle further comprising a substantially triangular portion and a gripping portion extending therefrom in a direction towards the door casing, a bushing to accommodate a pivot pin positioned in the triangular corner of said handle at the corner thereof proximate to the door edge surface accessible to said aligned to said bores in said bracket flange bores and providing an axis of rotation for said handle, a pawl protruding from said outer surface of said triangular portion engageable with grooves in a strike plate mounted on the door casing of or jam thereof of a door in secured closed position, and a torsion spring disposed in said handle to urge pressure to said pawl in said strike plate groove a slave push handle having an inner surface and an outer surface, said handle further comprising a flange bore secured at the fulcrum of a functionally triangular portion and a gripping portion extending therefrom in a direction away from the door casing, a bushing to accommodate a pivot pin at the distal triangular corner of said triangular portion from the door edge providing an axis of rotation for said slave handle, and a two ended flexible motion transfer belt disposed between said master and slave handles circumscribing the edged door surface, anchored by anchoring means at one end on said outer surface of said master pull hand triangular portion providing mechanical advantage in disengaging said pawl from said strike plate groove when said master handle is outwardly deflected, and at the other end anchored by anchoring means on the said inner surface of said slave handle to provide mechanical advantage to remotely disengage said pawl from said strike plate groove when said slave push handle is inwardly deflected.

2. The push-pull latch of claim 1 wherein said motion transfer belt is selected from the group consisting of a non-adhesive tape, a string, a wire, and a fabric thread.

3. The universal push-pull door latch of claim 1 wherein said mounting means is a screw, a bolt, an adhesive, or a double sided adhesive tape.

4. The push-pull door latch of claim 1 wherein component(s) thereof are fabricated from wood, metal, finish-coated metal, plastic, finished coated plastic or combinations thereof.

* * * * *